United States Patent [19]

Tha

[11] Patent Number: 4,738,103

[45] Date of Patent: Apr. 19, 1988

[54] HYDRAULIC CONTROL CIRCUIT FOR WORKING MEMBERS OF EARTH-MOVING MACHINES WITH CENTRALIZED BRAKING OF THE ACTUATORS

[75] Inventor: Piero Tha, Valperga, Italy

[73] Assignee: CHS Vickers S.p.A., Valperga, Italy

[21] Appl. No.: 9,908

[22] Filed: Feb. 2, 1987

[30] Foreign Application Priority Data

Feb. 4, 1986 [IT] Italy ..... 67086 A/86

[51] Int. Cl.[4] ..... F15B 13/08

[52] U.S. Cl. ..... 60/427; 60/452; 60/460; 91/518; 91/529

[58] Field of Search ..... 60/427, 452, 460; 91/517, 518, 529

[56] References Cited

U.S. PATENT DOCUMENTS 3,720,059 3/1973 Schurawski et al. ..... 60/427 X 3,817,153 6/1974 Zunzer ..... 91/529

FOREIGN PATENT DOCUMENTS 191275 8/1986 European Pat. Off. .

*Primary Examiner*—Gerald A. Michalsky

*Attorney, Agent, or Firm*—Pearne, Gordon, McCoy & Granger

[57] ABSTRACT

Hydraulic control circuit for working members of earth-moving machines including linear and rotary hydraulic actuators associated with respective hydraulic distributors for the operation of respective working members. The rotary hydraulic actuators with their distributors are grouped in a circuit separate from the linear hydraulic actuators and are provided with braking valve means constituted by a single counterbalance valve connected in a common discharge line, the opening of which is controlled by a pilot pressure signal corresponding to the lowest supply pressure for the rotary actuators.

8 Claims, 3 Drawing Sheets

Figure 1:
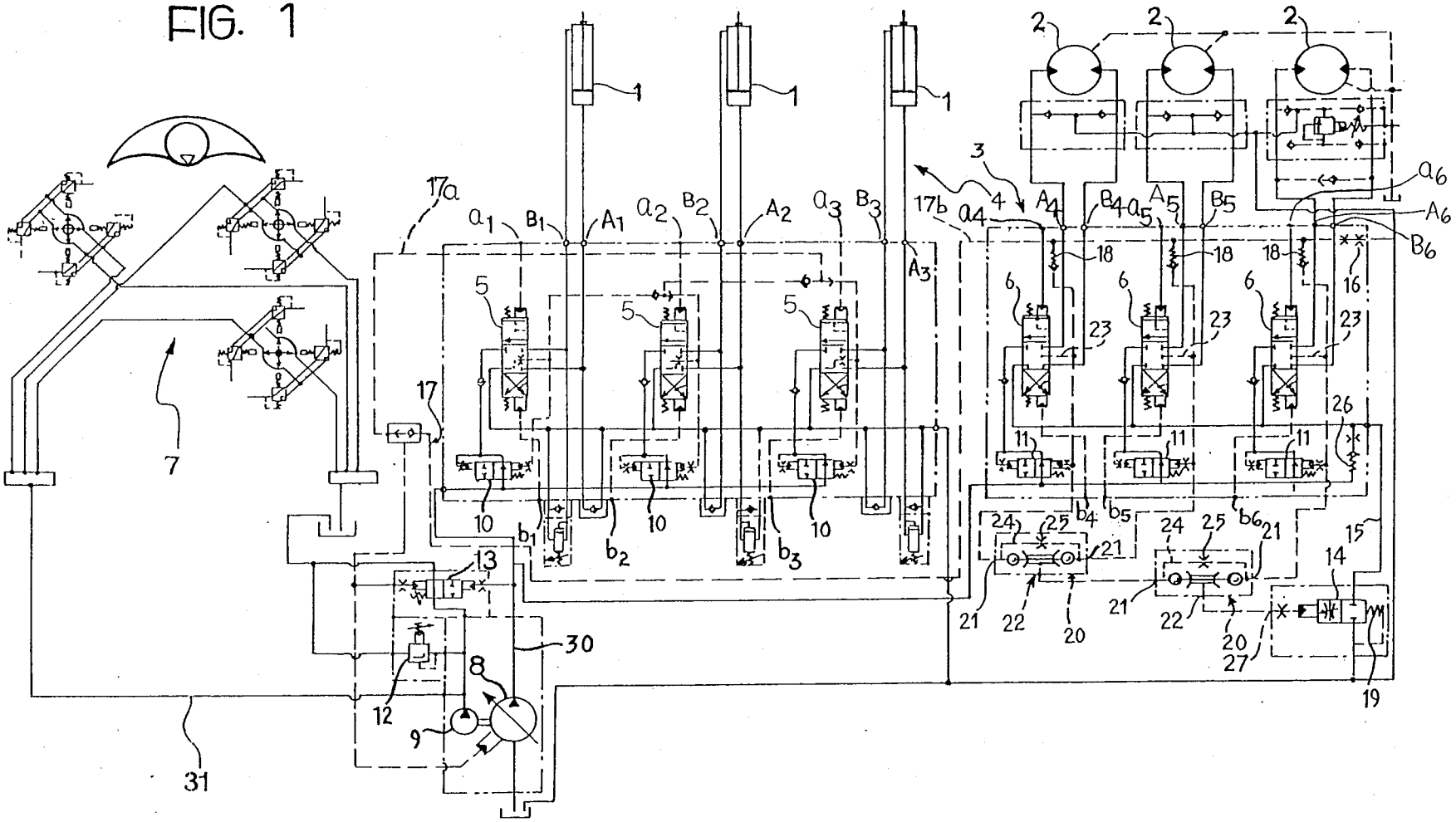

HYDRAULIC CONTROL CIRCUIT FOR WORKING MEMBERS OF EARTH-MOVING MACHINES WITH CENTRALIZED BRAKING OF THE ACTUATORS

The present invention relates in general to hydraulic control circuits for working members of earth-moving machines.

More particularly, the invention relates to a hydraulic control circuit of the type including a supply of pressurised hydraulic fluid and a plurality of hydraulic actuators, some linear and some rotary, for operating respective working members, each of which is associated with a respective spool-type hydraulic distributor which can be set, with continuous regulation, by respective pilot means in three positions corresponding to movement in a first direction, stoppage, and movement of the working member in a second direction opposite the first, and load-sensing pressure compensation means associated with the supply and the distributors for keeping the difference between the pressure supplied by the supply and the pressure of the working members substantially constant, and in which the rotary hydraulic actuators are associated with braking valve means piloted by the supply pressure of the rotary actuators and arranged to vary their discharge resistance as a function of the supply pressure.

Conventionally, in hydraulic control circuits of the aforesaid type, the braking valve means for the rotary hydraulic actuators are constituted by a plurality of counterbalance valves of the over-centre type, each associated with a respective rotary actuator.

The solution is relatively complicated and expesnive precisely because of the use of a counterbalance valve for each rotary actuator.

The object of the present invention is to avoid this disadvantage and provide a hydraulic control circuit of the type specified above which is simpler and cheaper to make and at the same time is highly efficient.

In order to achieve this object, the present invention provides a hydraulic control circuit of the type defined at the beginning, characterised in that the rotary hydraulic actuators and their distributors are grouped in a circuit separate from the linear hydraulic actuators and have a common discharge line, and in that the braking valve means include a single normally-closed counterbalance valve connected in the common discharge line, the opening of which is controlled by a pilot pressure signal corresponding to the lowest supply pressure for the rotary actuators.

Clearly, the dimensions of the commmon discharge line are such that it can withstand the maximum operating pressure of the circuit. The counterbalance valve, which is normally closed by a control spring, opens whenever the pressure delivered to the rotary actuators is greater than the calibrated value of the spring. In such a case, the valve allows the return of the hydraulic fluid from the actuators to the fluid reservoir. Whenever cavitation (or in any case a pressure less than the calibration threshold) is established in the delivery line to the rotary actuators in the presence of pulling rather than resisting torques acting on the actuators, the counterbalance valve returns towards the closed position to reduce the discharge area and hence the speed of rotation of the actuators.

According to a first embodiment of the invention, the pressure signal for commanding the opening of the counterbalance valve is directed to it through a logic system of selector valves. This logic system of selector valves comprises a series of low-pass selector valves, each having two inlets connected one to the load-sensing pressure signal of the distributor of one of the rotary actuators and the other to the load-sensing pressure signal of the distributor of another of the actuators or to the output of the previous selector valve, the two inlets of each of the selector valves being connected by a communicating passage provided with a calibrated choke.

Whenever one of the rotary actuators is stopped and its load-sensing pressure signal is therefore almost zero, the presence of the communicating passage avoids the sending of a zero pressure signal to the counterbalance valve by the corresponding low-pass selector valve. In effect, in this event, the communicating passage provides a pressure signal which, by virtue of the presence of the calibrated choke, does not in any case influence the effective pressure signal from the hydraulic actuator when it starts operating again.

According to one variant, the pilot pressure signal for commanding the opening of the counterbalance valve is directed to it from a supply of pressurized hydraulic fluid through a depressurising unit connected, in parallel with the counterbalance valve, with the load-sensing pressure signals of the distributors of the actuators through respective non-return valves.

In this case, the supply of pressurised hydraulic fluid is conveniently constituted by an auxiliary supply pump for the servo-controls for operating the distributors, the auxiliary pump being connected to the depressurising unit through a calibrated orifice and a non-return valve.

Figure 2:
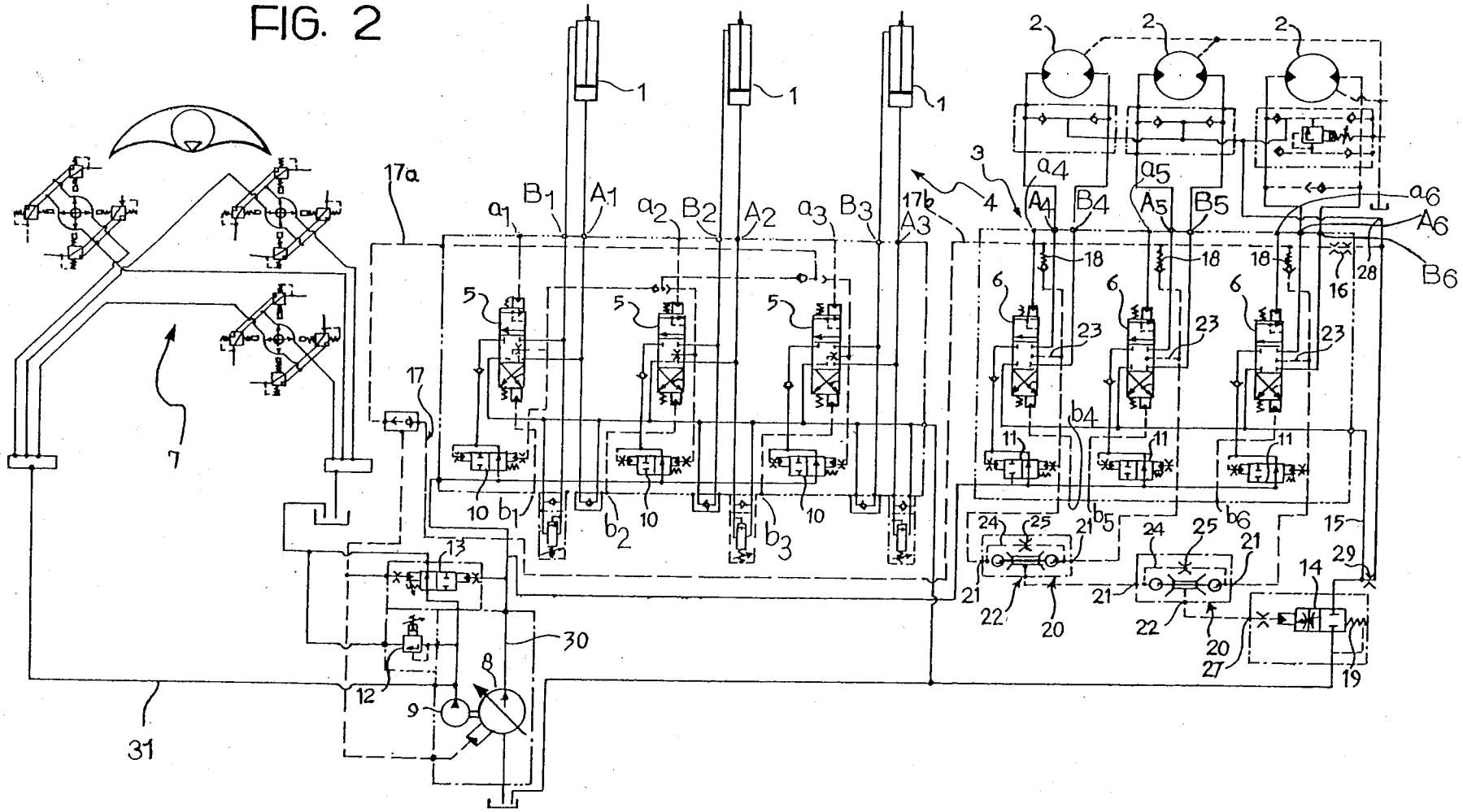
Figure 3:
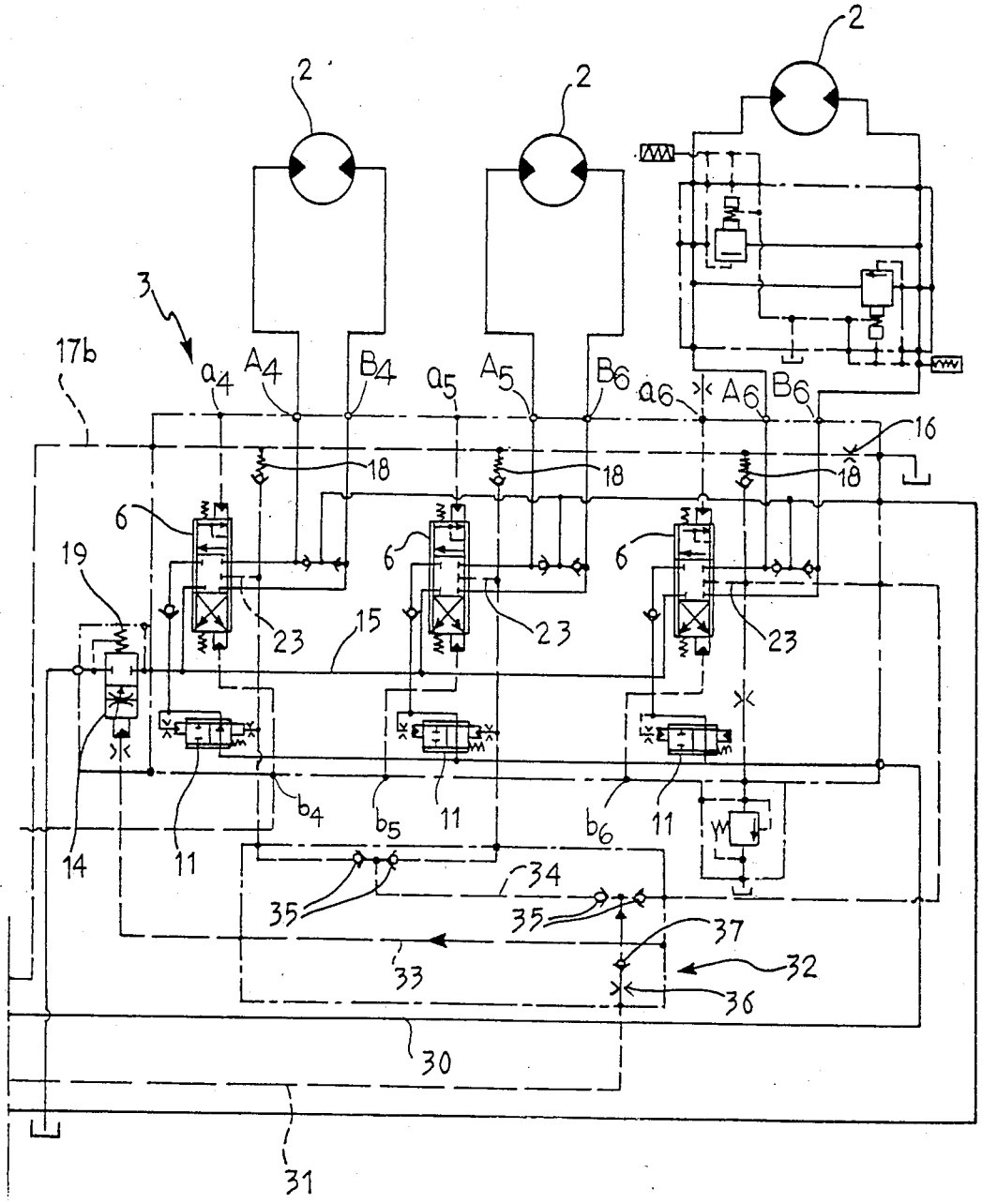

The invention will now be described in detail with reference to the appended drawings, provided purely by way of non-limiting example, in which:

FIG. 1 is a schematic diagram of a hydraulic control circuit according to the invention, and FIG. 2 illustrates a first variant of FIG. 1 and FIG. 3 illustrates a second variant of FIG. 1.

In FIG. 1, the essential components of a hydraulic control circuit for the working members of an earth-moving machine are illustrated diagrammatically. In the embodiment illustrated, these working members include a series of linear hydraulic actuators 1 for operating the digger arm (positioning-raising-penetrating-digging-overturning), and a series of rotary hydraulic motors 2 for the translational movements of the excavator and rotation of the digger arm.

As can be seen, the rotary motors 2, of which there are three in the embodiment illustrated, are combined in a group, generally indicated 3, which is distinct and separate from the group, indicated 4, of linear actuators 1:

Respective supply and discharge distributors 5, 6 for the actuators 1 and 2 are connected to the two groups 4, 3 respectively. Each distributor 5,6 can be set in three conditions corresponding respectively to movement in a first direction, stoppage, and movement in a second direction opposite the first, of the respective actuator 1, 2. The input-output connections between the distributors 5,6 and their actuators 1,2 are indicated in the drawing by $A_1$, $B_1$ . . . $A_6$ $B_6$.

The setting of the spools of the distributors 5, 6 in the three possible conditions is achieved by virtue of the hydraulic piloting effected by a servo-control valve unit, generally indicated 7, including, in known manner, a series of lever and pedal controls which can be moved manually into different positions corresponding to the said conditions of distributors 5,6. The output-input pilot connections between the servo-controls 7 and the distributors 5, 6 are indicated $a_1$, $b_1$ . . . $a_6$,$b_6$.

The supply of the distributors 5,6 (and hence the working members 1,2) and of the servo-controls 7 is achieved, in the example illustrated, by means of two separate hydraulic pumps 8,9, through respective delivery lines 30, 31.

The pump 8 has a control of known load-sensor type achieved through a control circuit 17 including a line 17*a* associated with the group 4 in a conventional manner and a line 17*b* associated with the group 3 and including selector valves 18 constituted, in effect, by simple non-return ball valves connected in correspondence with signal outlets 23, by means of which there is derived a load-sensing pressure signal greater than that coming from the distributor 6 in operation.

The distributors 5,6 have respective associated compensators 10, 11 constituted by control valves which, in known manner, have the function of keeping the difference between the pressure supplied by the pump 8 and that of the working members 1, 2 substantially constant in use, so as to ensure the simultaneity of the various possible working movements of the machine whatever the loads controlled.

The hydraulic servo-control devices 7 are supplied by the pump 9 under the control of a maximum pressure valve 12. This maximum pressure valve has an associated valve 13 the function of which is to prevent saturation of the hydraulic circuit. The manner in which the valve 13 operates is described and illustrated in European Patent Application No. 85830286.2 which is also owned by the assignee herein.

The rotary hydraulic motors 2 have associated braking valve means piloted by the pressure in the supply line for these motors 2 and arranged to vary the discharge resistance of the motors themselves in dependence on the pressure existing in the supply line. In practice these braking valve means have the function of braking the hydraulic motors 2 in such a manner that the number of revolutions of the motors themselves is independent of the load applied thereto and is instead controlled solely by the flow of fluid at the input to the motors.

According to the invention, these braking valve means are constituted by a single centralised counterbalancing valve 14 constituted by a normally-closed, directional, two-way control valve which is connected in a common discharge line 15 for the three distributors 6. Clearly, this common discharge line 15 is of such dimensions as to withstand the maximum operating pressure of the system and the spools of the distributors 6 are not connected to this line 15 in the neutral position, but the depressurising of the load-sensing signal occurs through a common bleed-off choke 16 located in parallel with the non-return valves 18 through which the load-sensing control signals are sent from the distributor 6 to the pump 8 through the line 17*b*.

As stated, the counterbalancing valve 14 is normally closed under the action of a control spring 19 and is subject to the action of a piloting pressure from a logic system of selector valves 20 and corresponding to the lowest supply pressure for the rotary motors 2. In effect, this logic system includes, in the example illustrated, two selector valves of the low-pass type each having two inputs 21 and an output 22. The two inputs 21 of the first valve 20 are connected to the outlets 23 for the load-sensing pressure signals of the distributor 6 associated with two of the rotary motors 2, while the two inputs 21 of the second valve 20 are connected one to the output 22 of the first valve 20 and the other to the outlet 23 for the load-sensing pressure signal of the third rotary motor 2.

The output 22 of the second valve 20 is connected to the pilot input 27 of the valve 14.

Each of the low-pass selector valves 20 has a communicating passage 24 which interconnects the respective inputs 21 and in which there is connected a calibrated choke 25.

The counterbalancing valve 14 has an associated recycling system for directing a flow of fluid from the discharge line 15 to the input of the compensation valve 11, and hence to the delivery of the distributor 6, when the counter-pressure generated by the valve 14 is greater than the pressure existing in the delivery to the distributor 6. In practice, the system includes a non-return valve 26 which is inserted between the common discharge line 15 and the supply for the compensation valves 11 and, to advantage, enables the operating inertias of the counterbalance valve 14 to be reduced so as to stabilize the braking action.

Alternatively, the recycling system could be achieved in the manner illustrated in FIG. 2 (in which parts identical to or similar to those described with reference to FIG. 1 are indicated by the same reference numerals) by connection of the discharge line 15 to the passage 28 through a choke 29.

In operation, when the delivery pressure to the motors 2 is greater than the calibration value of the spring 19, the counterbalancing valve 14 opens to allow the oil returning from the motors 2 to flow to the reservoir through the common discharge line 15. Whenever cavitation (or at least a pressure below the calibration threshold) is established in the delivery line to the motors 2 in the presence of pulling rather than resisting torques acting on these motors 2, the valve 14 moves to the closed position to reduce the discharge area and hence the speed of the motors 2. In this situation, the recycle flow achieved through the valve 26 enables the reduction of the operating inertia of the valve 14 and hence the stabilization of the braking action, as stated.

The presence of the logic system of selector valves 20 enables the counterbalancing valve 14 to operate even when only one motor is cavitating. In practice, the valve 14 prevents this caviation and its effect on the other motor 2 consists of a simple increase in the delivery pressure while the working torque remains constant.

Whenever one of the motors 2 is stopped (an almost zero load) and the respective pressure signal is substantially equal to zero, the communicating passages 24 enable the pressurisation of the line of the stopped motor, thus directing a pressure signal other than zero to the valve 14. Because of the presence of the calibrated choke 25, this pressure signal obtained through the passage 24 does not influence the pressure signal of the motor when it starts to operate normally again.

As an alternative to the logic system of selector valves 20, the pilot pressure signal for the counterbalancing valve 14 may be obtained in the manner illustrated in the variant of FIG. 3. In this variant, in which parts identical or similar to those described previously are indicated by the same reference numerals, the pilot pressure for the counterbalancing valve 14 is taken from the auxiliary pump 9 which supplies the servo-controls 7. In effect, hydraulic fluid supplied by the pump 9 through the line 31 at a low rate of flow reaches a pressurising block 32 including a passage 33 connected at one side to the passage 31 through a calibrated orifice 36 and a non-return valve 37 and at the other side to the pilot section of the counterbalancing valve 14. The pressurising unit 32 also includes a line 34 connected in parallel with the line 33 and connected through two pairs of non-return valves 35 to the load-sensing pressure signal outlets 23 of the distributors 6 of the three rotary actuators 2.

By means of the non-return selector valves 18 for the load-sensing signal, the pressure input to the pressurising unit 32 is connected (with the distributors 6 in the neutral position) to discharge through the bleed-off choke 16.

In operation, the pressure output by the pressurising unit 32 is such as to keep the counterbalancing valve 14 in the normally-open position against the action of the spring 19.

On operation of one or more of the distributors 6, the load-sensing pressure which is sent through the line **17*b* causes the closure of the non-return valves 18 associated with the distributors 6 which remain in the neutral position. The two pairs of non-return valves 35 enable the pressurised fluid flow supplied by the auxiliary pump 9 to the pressurising unit 32 through the choke 36 to pressurise the line 33 and keep the counterbalancing valve 14** in the open position.

The lines 23 being connected to the delivery ducts of the rotary motors 2 through the respective distributors 6, if the pressure in one of these delivery ducts decreases because of pulling torgues below the pressure value in the line 33, the corresponding non-return valve 35 opens to depressure the line 33. Consequently, the counterbalancing valve 14 closes to a proportional extent, throttling the discharge flow from the motor subjected to pulling forces, so as to brake it and hence prevent its cavitation.

By virture of the non-return valves 35, when several rotary motors 2 are simultaneously in these conditions, the counterbalancing valve 14 is closed even in this case by the lower pressure delivery line of the rotary motors 2.

This variant has the advantage over the embodiments described previously with reference to FIGS. 1 and 2 of using ordinary non-return valves for the selection of the lower pressure signal and of not requiring recourse to by-pass lines for taking account of the inoperative condition of one or more of the rotary motors 2.

I claim:

1. Hydraulic control circuit for working members of earth-moving machines, including a supply of pressurised hydraulic fluid and a plurality of hydraulic actuators, some linear and some rotary, for operating respective working members, a respective spool-type hydraulic distributor associated with each actuator and adapted to be set, with continuous regulation, in three positions corresponding to movement in a first direction, stoppage, and movement of the working member in a second direction opposite the first, servo-control means for operating the said hydraulic distributors, and load-sensing pressure compensation means associated with the supply and the distributors for keeping the difference between the pressure supplied by the supply and the pressure of the working members substantially constant, and in which to the rotary hydraulic actuators braking valve means are associated, piloted by the supply pressure of the rotary actuators and arranged to vary their discharge resistance as a function of the supply pressure, wherein the rotary hydraulic actuators and their distributors are grouped separately from the linear hydraulic actuators and have a common discharge line, and the braking valve means include a single normally-closed counterbalance valve connected in the common discharge line, the opening of which is controlled by a pilot pressure signal corresponding to the lowest supply pressure for the rotary actuators.

2. Circuit according to claim 1, comprising a logic system of selector valves for directing to the said counterbalance valve the pilot pressure signal for commanding the opening thereof.

3. Circuit according to claim 2, wherein the logic system of selector valves comprises a series of low-pass selector valves, each having two inlets one of which is connected to the load-sensing pressure signal of the distributor of one of the rotary actuators or to the output of the previous selector valve, and a communicating passage provided with a calibrated choke connecting the two inlets of each of the selector valves.

4. Circuit according to claim 3, wherein the counterbalance valve has associated recycling means for directing a flow of fluid from the discharge line to the delivery of the rotary actuators when the counter-pressure generated by the counterbalance valve is greater than the delivery pressure to the distributors.

5. Circuit according to claim 2 wherein the counterbalance valve has associated recycling means for directing a flow of fluid from the discharge line to the delivery of the rotary actuators when the counter-pressure generated by the counterbalance valve is greater than the delivery pressure to the distributors.

6. Circuit according to claim 5, wherein the recycling means include a non-return valve located between the common discharge line and the delivery of the rotary actuators.

7. Circuit according to claim 1, comprising a supply of pressurized hydraulic fluid, a depressurising unit connected, in parallel with the counterbalance valve, with the load-sensing pressure signals of the distributors of the actuators, and respective non-return valves through which the said depressurizing unit is connected with the said load-sensing pressure signals, the said pilot pressure signal for commanding the opening of the counterbalance valve being directed thereto through the said supply and depressurizing unit.

8. Circuit according to claim 7, comprising an auxiliary supply pump for the said servo-controls means for operating the distributors, wherein the supply of pressurized hydraulic fluid is the said auxiliary pump, and further comprising a calibrated orifice and a non-return valve through which the said auxiliary pump is connected to the said depressurizing unit.

* * * * *